United States Patent [19]

Nagura

[11] 4,242,211

[45] Dec. 30, 1980

[54] LUBRICANT FOR METAL WORKING

[75] Inventor: Torao Nagura, Yokohama, Japan

[73] Assignee: Mitsubishi Jukogyo Kabushiki Kaisha, Tokyo, Japan

[21] Appl. No.: 10,168

[22] Filed: Feb. 7, 1979

[30] Foreign Application Priority Data

Feb. 7, 1978 [JP] Japan ..... 53/11952
Feb. 7, 1978 [JP] Japan ..... 53/11953

[51] Int. Cl.[3] ..... C10M 1/10
[52] U.S. Cl. ..... 252/25; 252/52 A
[58] Field of Search ..... 252/25, 29, 52 A

[56] References Cited

U.S. PATENT DOCUMENTS

| | | | |
|---|---|---|---|
| 2,704,744 | 3/1955 | Hugel et al. | 252/25 X |
| 2,820,764 | 1/1958 | Hughes et al. | 252/25 |
| 2,952,335 | 9/1960 | Colt et al. | 252/52 A X |
| 3,071,543 | 1/1963 | McGee | 252/29 X |
| 3,124,531 | 3/1964 | Whetzel et al. | 252/52 A |
| 3,249,538 | 5/1966 | Freier | 252/25 X |
| 3,256,186 | 6/1966 | Greenwald | 252/25 X |
| 3,995,465 | 12/1976 | Felton | 252/52 A X |

FOREIGN PATENT DOCUMENTS

| | | | |
|---|---|---|---|
| 524879 | 5/1956 | Canada | 252/25 |

*Primary Examiner*—Helen M. S. Sneed

[57] ABSTRACT

A lubricant for metal working which is positively free of oily matter is prepared by mixing a polyethylene oxide with water and/or a polyhydric alcohol to form a paste, with or without the addition of a solid powder lubricant to the resulting paste.

19 Claims, No Drawings

LUBRICANT FOR METAL WORKING

This invention relates to a novel lubricant for metal working which is positively free of oily matter and is soluble in water.

Generally, in the manufacture of boilers, a lubricant such as a mineral oil, animal or vegetable oil, grease or the like is employed for the expansion of boiler tubes. Such Oily matter must be thoroughly removed before the start of boiler operation. This has usually been accomplished by a degreasing and cleaning operation that relies on so-called soda cooking, in which the oily matter is emulsified for subsequent removal by the addition of a large quantity of sodium hydroxide, sodium carbonate, sodium phosphate, sodium sulfite or the like and by boiling together up to a predetermined pressure.

The ordinary degreasing method, however, has shortcomings of high cost and labor requirements. In addition, the resulting waste liquid that contains oily matter cannot be discharged after a mere neutralizing treatment, but must be cleaned to the local effluent standard value for environmental protection (an oil content of not more than 5 ppm or, in some districts, not more than 1 ppm). The treatment of waste liquid to reach this degree of cleanliness involves enormous cost.

A more recent trend in the art is to use a water-soluble cutting oil as the lubricant in order to simplify the process of degreasing and cleaning. The used cutting oil is thoroughly washed away by hot water or hydrazine but, because the waste liquid still contains oily matter, the problem of disposal of the waste remains.

In view of the foregoing, an object of this invention is to provide a novel lubricant for metal working which does not require no degreasing or cleaning and therefore no waste liquid treatment.

In brief, the lubricant of the invention for pipe expanding is a completely oil-free, neutral, and water-soluble lubricant prepared by forming a paste from a mixture of a polyethylene oxide with water and/or a polyhydric alcohol, with or without the addition of a solid powder lubricant to the resulting paste.

According to the invention the polyethylene oxide $-(CH_2CH_2O)-_n$ is used as the base for imparting lubricity to the lubricant. Polyethylene oxides ranging in molecular weight from 300 to 10,000 may be employed. Depending on whether the product is to be free of polyhydric alcohol or not, a polyethylene oxide with a molecular weight from 1,000 and 4,000 or 600 and 4,000, respectively, is advantageously used because such alcohols are easily formed into pastes.

The amount of water added to the polyethylene oxide varies with the molecular weight of the oxide used, but by rule of thumb it need only be sufficient for forming the oxide into paste which is not readily flowable. Polyethylene oxides with molecular weight ranges from 300 to 10,000 are viscous and waxy, and in order to form a non-flowing paste, the amount of water may be small for an oxide with a molecular weight of about 300 but will be large for an oxide with a molecular weight of about 10,000. Usually, water is added to account for from 5 to 60% by weight of the total amount of the lubricant of the invention for metal working.

The polyhydric alcohol added to the polyethylene oxide not only imparts added lubricity to the resulting lubricant but also serves to convert polyethylene oxides with a relatively high molecular weights from the waxy to a pasty state. Therefore, a highly viscous alcohol, such as glycerol, ethylene glycol, diethylene glycol, triethylene glycol, propylene glycol, dipropylene glycol, butylene glycol, or hexylene glycol, gives good result. Such a polyhydric alcohol is desirably used in a proportion ranging from 5 to 65% by weight of the total amount of the lubricant for metal working according to the invention, although the actual proportion may vary with the kind of the polyethylene oxide employed.

It sometimes occurs that a polyethylene oxide with a molecular weight between 300 and 10,000 and therefore in a viscous, waxy state does not form a paste with one of the above-mentioned highly viscous polyhydric alcohols. When this happens, the remedy is further addition of water. While the amount of water added depends upon the molecular weight and viscosity of the polyethylene oxide used of, an amount just sufficient to form a paste with the polyethylene oxide and polyhydric alcohol to a nonfluid state is desirable.

The solid powder lubricant used in accordance with the invention will improve the workability as well as the lubricity of the resulting lubricant. Examples of such additives are talc, molybdenum disulfide, and graphite. Desirably the additive accounts for from 0.5 to 20% by weight of the total amount of the lubricant working. The solid powder lubricant may be any of those which are normally commercially available.

The lubricant of the invention is prepared simply by mixing water and/or a polyhydric alcohol with polyethylene oxide at ordinary temperature or at between about 40° and 70° C. The lubricant prepared by heating to about 40°-70° C. will become pasty on cooling to ordinary temperature. The addition of the solid powder lubricant may be effected at ordinary temperature or at the higher temperature of about 40°-70° C.

When it is used for pipe expanding, the lubricant according to the invention is applied in advance on the sliding surfaces (i.e., on the pipe expanding parts) of the expander. For this application the lubricant is in the form of a paste to act effectively on those surfaces without loss due to flow from the surfaces to be lubricated.

Although the lubricant according to the invention has been described as used in the expanding of tubing for boilers, it should be obvious to those skilled in the art that the lubricant may be applied to the expanding for the manufacture of heat exchangers and other apparatus and also to working of metals in general.

The lubricant of the invention for metal working is:

(1) positively free of oily matter, (2) neutral and soluble in water, and (3) low in chemical oxygen demand and suspended matter. Therefore, when employed in the manufacture of a boiler, the lubricant eliminates the necessity of degreasing and washing before the initiation of boiler operation. Hence there is no problem of water liquid disposal and therefore, remarkable reductions in labor and chemical costs, and total working time required for the manufacture.

Additional advantages of the lubricant of the invention include (4) cleanliness with no toxicity or offensive odor, (5) ease of applicability, (6) economy in application without loss due to flow from the surface, and (7) sufficiently good lubricity to ensure exactly the same facility and finish of pipe expanding as with ordinary lubricants.

The present invention is illustrated by the examples tabulated below, in which all parts are given by weight.

Examples

| No. | Polyethylene oxide mol. wt. 1,000 | mol. wt. 3,000 | mol. wt. 6,000 | Water | Solid powder lubricant Talc | $MoS_2$ | Graphite | Applicability & workability in pipe expanding |
|---|---|---|---|---|---|---|---|---|
| 1 | 100 | | | 20–30 | | | | Good |
| 2 | 100 | | | 20–30 | 1–25 | | | Excellent |
| 3 | 100 | | | 20–30 | | 1–25 | | " |
| 4 | | 100 | | 50–60 | 1–25 | | | " |
| 5 | | 100 | | 50–60 | | 1–25 | | " |
| 6 | 50 | 50 | | 50 | | | | Good |
| 7 | 50 | 50 | | 50 | 1–25 | | | Excellent |
| 8 | 50 | 50 | | 50 | | 1–25 | | " |
| 9 | 50 | 50 | | 50 | | | 1–25 | " |
| 10 | | | 50 | 70 | | | | Good |
| 11 | | | 50 | 70 | 1–25 | | | Excellent |
| 12 | | | 50 | 70 | | 1–25 | | " |
| 13 | | 50 | 30 | 70–80 | | | | Good |
| 14 | | 50 | 30 | 70–80 | 1–25 | | | Excellent |
| 15 | | 50 | 30 | 70–80 | | 1–25 | | " |

| No. | Polyethylene oxide mol. wt. 1,000 | mol. wt. 3,000 | mol. wt. 6,000 | Water | Polyhydric alcohol ethyl. glycol | Propyl. glycol | Solid powder lubricant Talc | $MoS_2$ | Applicability & workbly. in expandg. |
|---|---|---|---|---|---|---|---|---|---|
| 16 | 100 | | | 10 | 10 | | | | Good |
| 17 | 100 | | | 10 | 10 | | 1–20 | | " |
| 18 | 100 | | | 10 | 10 | | | 1–20 | " |
| 19 | 100 | | | 10 | | 10 | | | " |
| 20 | 100 | | | 10 | | 10 | 1–20 | | " |
| 21 | 100 | | | 10 | | 10 | | 1–20 | " |
| 22 | | 50 | 30 | 20 | | 20–50 | 1–50 | | " |
| 23 | | 50 | | | 30–80 | | | | " |
| 24 | | 50 | | | | 30–80 | | | " |
| 25 | | 50 | | | 30–80 | | 1–20 | | " |
| 26 | | 50 | | | | 30–80 | | 1–20 | " |

In experiments for reference the solid powder lubricants alone were employed for pipe expanding. The results were very unsatisfactory with poor applicability and workability. The solid lubricants, when formed into pastes with starch, caused inconvenience by sticking fast to the surfaces of the expander.

What is claimed is:

1. A water soluble paste for metal working consisting essentially of polyethylene oxide and water.

2. A paste according to claim 1, in which the molecular weight of the polyethylene oxide is from 300 to 10,000.

3. A paste according to claim 1, in which the amount of water is from 5 to 60% by weight.

4. A paste according to claim 1 additionally containing a solid powder lubricant.

5. A paste according to claim 4, in which said powder lubricant is from 0.5 to 20% by weight of the total amount of said paste.

6. A paste according to claim 5 in which said solid powder lubricant is at least one lubricant selected from the group consisting of talc, molybdenum disulfide, and graphite.

7. A paste according to claim 1 additionally containing a ployhydric alcohol.

8. A paste according to claim 7, in which said polyhydric alcohol is from 5 to 65% by weight of the total amount of said paste.

9. A paste according to claim 8, in which said polyhydric alcohol is at least one alcohol selected from the group consisting of glycerol, ethylene glycol, diethylene glycol, triethylene glycol, propylene glycol, dipropylene glycol, butylene glycol, and hexylene glycol.

10. A paste according to claim 7 additionally containing a solid powder lubricant.

11. A paste according to claim 10, in which said powder lubricant is from 0.5 to 20% by weight of the total amount of said paste.

12. A paste according to claim 11, in which said solid powder lubricant is at least one lubricant selected from the group consisting of talc, molybdenum disulfide, and graphite.

13. A water soluble paste for metal working consisting essentially of polyethylene oxide and a polyhydric alcohol.

14. A paste according to claim 13, in which said polyethylene oxide ranges in molecular weight from 300 to 10,000.

15. A paste according to claim 13, in which said polyhydric alcohol is from 5 to 65% by weight of the total amount of said paste.

16. A lubricant according to claim 15, in which said polyhydric alcohol is at least one alcohol selected from the group consisting of glycerol, ethylene glycol, diethylene glycol, triethylene glycol, propylene glycol, dipropylene glycol, butylene glycol, and hexylene glycol.

17. A paste according to claim 13 additionally containing a solid powder lubricant.

18. A paste according to claim 17, in which said powder lubricant is from 0.5 to 20% by weight of the total amount of said paste.

19. A paste according to claim 18, in which said solid powder lubricant is at least one lubricant selected from the group consisting of talc, molybdenum disulfide, and graphite.

* * * * *